US006410870B1

(12) United States Patent
Nishizaki et al.

(10) Patent No.: US 6,410,870 B1
(45) Date of Patent: Jun. 25, 2002

(54) PNEUMATIC ACTUATED SWITCH

(75) Inventors: Kurt J. Nishizaki, Huntsburg; Walter M. Swick, Concord, both of OH (US)

(73) Assignee: Tecmark Corporation, Mentor, OH (US)

( * ) Notice: Subject to any disclaimer, the term of this patent is extended or adjusted under 35 U.S.C. 154(b) by 0 days.

(21) Appl. No.: 09/534,784

(22) Filed: Mar. 24, 2000

(51) Int. Cl.[7] ..... H01H 35/40
(52) U.S. Cl. ..... 200/83 R; 200/81 R
(58) Field of Search ..... 200/81 R, 520, 200/82 R, 82 C, 83 R, 83 B, 83 J, 83 N, 83 A

(56) References Cited

U.S. PATENT DOCUMENTS 4,882,459 A * 11/1989 Edwards, Jr. et al. ..... 200/83 J
5,118,909 A * 6/1992 Husting ..... 200/81 H
5,471,022 A 11/1995 Kiss et al. ..... 200/83 B

* cited by examiner

*Primary Examiner*—P. Austin Bradley
*Assistant Examiner*—Lisa N Klaus
(74) *Attorney, Agent, or Firm*—Mark Kusner; Michael A. Jaffe

(57) ABSTRACT

A pressure switch comprising a housing having a pressure chamber, a port communicating with the pressure chamber and a recessed throat located where the port communicates with the chamber. A flexible diaphragm is disposed within the housing adjacent the pressure chamber, and an electric switch is mounted to the housing. A pressure plate is disposed between the diaphragm and the port. The pressure plate has a first surface contoured to mate with a portion of the diaphragm and a second surface facing the port having a plurality of projections extending from the second surface. The projections are dimensioned to engage the throat portion and maintain the second surface therefrom. The projections define passageways where the port communicates with the chamber when the projections engage the throat.

12 Claims, 3 Drawing Sheets

PNEUMATIC ACTUATED SWITCH

FIELD OF THE INVENTION

The present invention relates generally to electrical switch devices, and more particularly, to a pneumatic actuated electrical switch that is responsive to a vacuum exerted thereon.

BACKGROUND OF THE INVENTION

Pneumatic actuated switches are used in applications where it is desirable to actuate an electrical component at a remote location in response to a change in pressure, generally at a remote source. Such switches typically have a diaphragm assembly disposed adjacent to an electrical switch. The diaphragm assembly includes a resilient diaphragm element disposed adjacent a pressure chamber. The diaphragm element is designed to move and actuate the switch in response to a change in pressure in the pressure chamber. In general, the pressure chamber is connected by a circuit or channel, typically tubing, to a remote pressure source. The actuator and circuit or channel leading up to the pressure chamber are airtight to insure transfer of a pressure pulse from an actuator or a pressure source into the pressure chamber.

As with most electrical components, there have been ongoing efforts to reduce the size and cost of such switches, while at the same time maintaining or enhancing their performance. As the size and number of components in a switch become smaller and smaller, positioning and maintaining alignment of the operative components during assembly of the switch, and later during operation of the switch, become more important. In this respect, a pneumatic actuated switch is typically assembled by hand, and is generally enclosed within a housing in such a fashion that it is difficult to determine if the switch components are properly aligned during assembly and during operation, i.e., when the housing is closed or sealed.

The present invention provides a vacuum actuated pressure switch having internal components dimensioned to align themselves along a switch axis during assembly and operation.

SUMMARY OF THE INVENTION

In accordance with a preferred embodiment of the present invention, there is provided a pressure switch comprising a housing having a pressure chamber, a port communicating with the pressure chamber and a recessed throat located where the port communicates with the chamber. A flexible diaphragm is disposed within the housing adjacent the pressure chamber, and an electric switch is mounted to the housing. A pressure plate is disposed between the diaphragm and the port. The pressure plate has a first surface contoured to mate with a portion of the diaphragm and a second surface facing the port having a plurality of projections extending from the second surface. The projections are dimensioned to engage the throat portion and maintain the second surface therefrom. The projections define passageways where the port communicates with the chamber when the projections engage the throat.

In accordance with another aspect of the present invention, there is provided a pressure switch comprising a housing having an upper housing section and a lower housing section. The lower housing section has a port extending therethrough and a contoured surface surrounding the port. A diaphragm disposed within the housing is captured between the upper housing section and the lower housing section. The diaphragm defines a pressure relief chamber with the upper housing section, and a pressure chamber with the lower housing section. The diaphragm is formed of a flexible material and has a neutral, unflexed configuration. A pressure plate is disposed between the diaphragm and the port. The pressure plate has a first surface contoured to mate with a portion of the diaphragm. A second surface faces the port and has a projection extending from the second surface. The projection is dimensioned to engage the contoured surface and to maintain the second surface therefrom. The projection defines a passageway wherein the port communicates with the chamber when the projection engages the contoured surface.

It is an object of the present invention to provide a vacuum actuated electrical switch.

Another object of the present invention is to provide a switch as described above having internal components with surface features that self align the components along a switch axis during assembly and maintain alignment of the components during operation.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
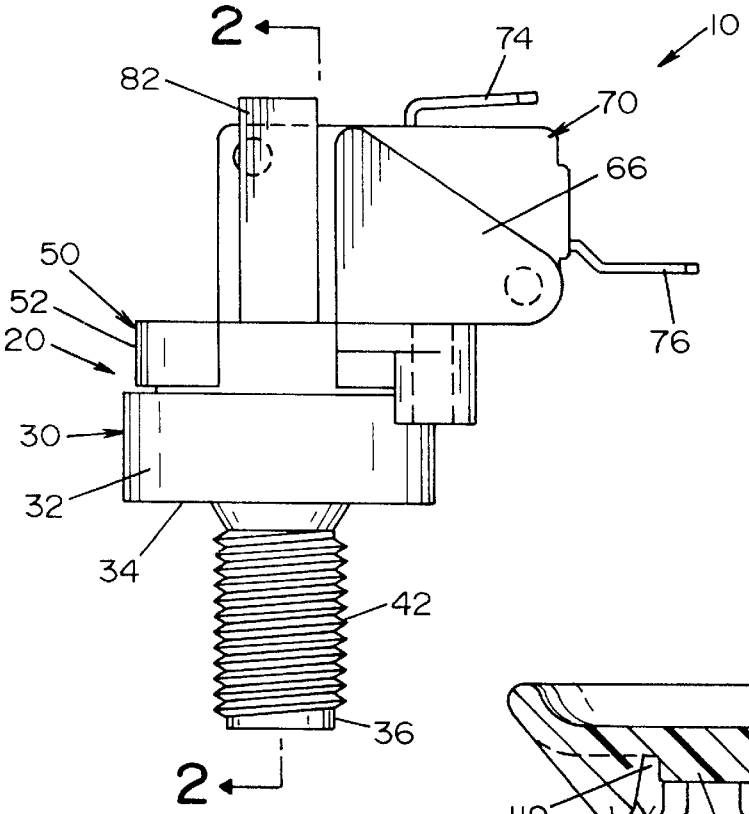
FIG. 1 is a side, elevational view of a vacuum actuated switch illustrating a preferred embodiment of the present invention.

Referring now to the drawings wherein the showings are for the purpose of illustrating the preferred embodiment of the invention only, and not for the purpose of limiting same, the drawings show a pneumatic actuated switch 10. Switch 10 is generally comprised of a housing 20 having a base section 30 and a cover section 50, which are adapted to be attached to one another. Base section 30 and cover section 50 are preferably formed of molded plastic. In the embodiment shown, housing 20 is generally cylindrical in shape and includes a generally cylindrical inner cavity 22 (best seen in FIG. 2) which is dimensioned to receive a diaphragm element 100. Diaphragm element 100 is mounted between base section 30 and cover section 50 to define a pressure chamber 24 below diaphragm element 100 in a pressure relief chamber 26 above diaphragm element 100.

Base section 30 (best seen in FIG. 2) of housing 20 is generally cup-shaped and has a cylindrical side wall 32 and an end wall 34. A shank 36 extends from end wall 34 of base section 30. Shank 36 is tubular and defines an internal channel 38 that communicates with pressure chamber 24. Shank 36 includes external threads 42 to define a male fitting. In the embodiment shown, threads 42 are standard pipe threads adapted to receive a pressure port connection or a hose or tube fitting (not shown) that secures a hose or tube (not shown) to housing 20 in a conventionally known fashion. A portion of channel 38 includes internal threads 44 to receive an adjustment element 130 as shall hereinafter be described. Where channel 38 communicates with pressure chamber 24, base section 30 includes a conical surface 46, that in the embodiment shown, is conical in shape and defines a throat or recess 48.

Figure 2:
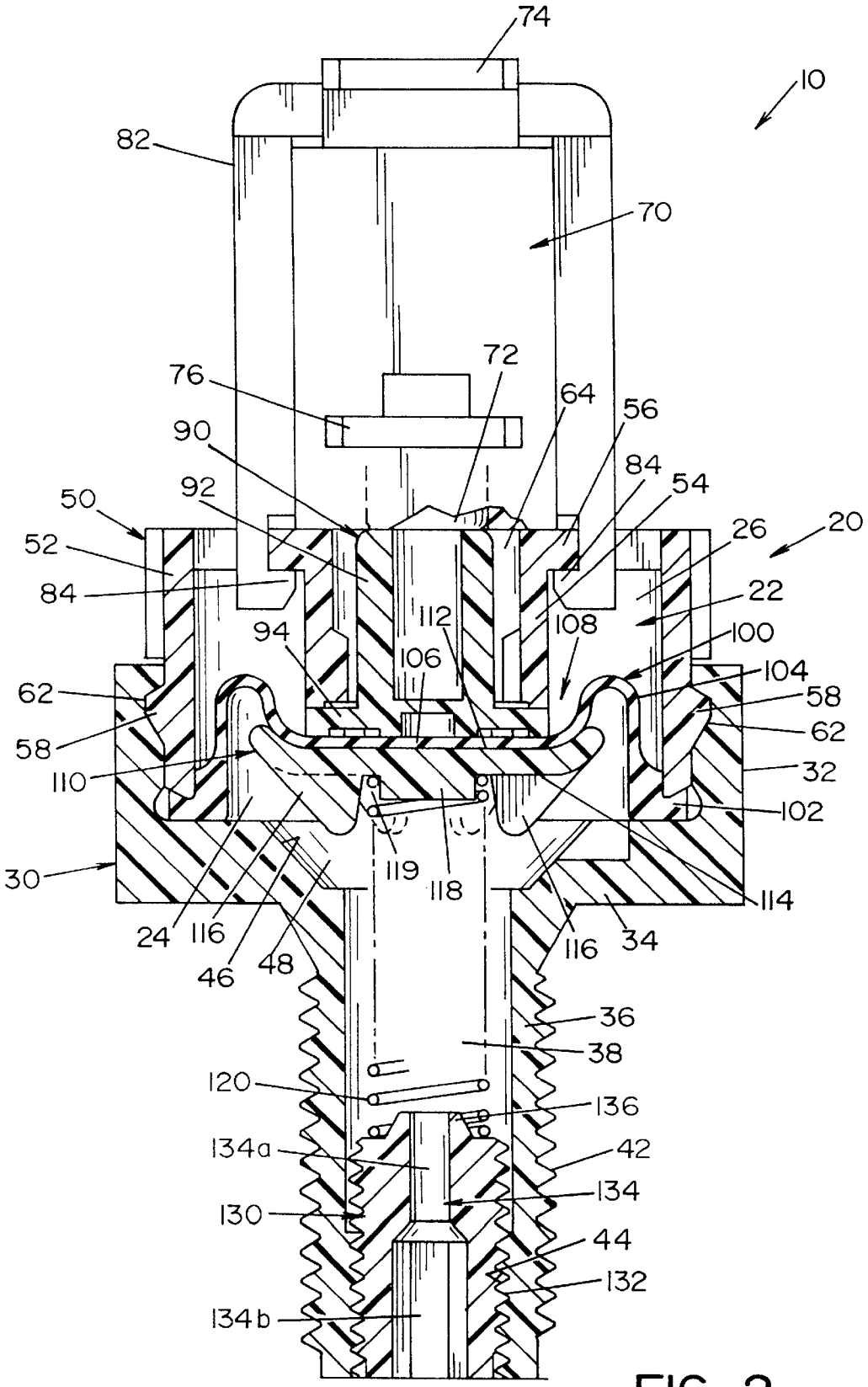
FIG. 2 is an enlarged, partially sectioned view of the switch shown in FIG. 1.

Cover section 50 is also cylindrical in shape and includes a cylindrical outer wall 52, a smaller and shorter cylindrical inner wall 54 and an end wall 56 that connects one end of outer wall 52 to one end of inner wall 54. Outer wall 52 of cover section 50 is dimensioned to snuggly fit within side wall 32 of base section 30, as best seen in FIG. 2. Tabs 58 are formed on the outer surface of wall 52 to snap lock into recesses 62 in base section 30. In this respect, in the embodiment shown, cover section 50 basically snap locks into engagement with base section 30. Inner wall 54 defines a cylindrical opening 64 that extends through cover section 50. Two, spaced apart plates 66 (best seen in FIG. 1) are formed on cover section 50 and define a space therebetween to receive a switch 70. Switch 70 has a switch button 72 (shown in phantom in FIG. 2) that actuates switch 70. Switch 70 is received by and between plates 66 on cover section 50, such that switch button 72 is disposed within opening 64 in cover section 50. Switch 70 is preferably a conventional, momentary micro switch and includes an upper switch terminal 74 and a lower switch terminal 76 that extends to one side therefrom.

A generally U-shaped retainer 82 is provided to position switch 70 relative to housing 20. The lower ends of U-shaped retainer 82 include tabs 84 that are adapted to extend through openings in end wall 56 and to lock onto a portion thereof. Switch 70 is attached to housing 20 with switch button 72 aligned with opening 64 defined by cover section 50.

Figure 5:
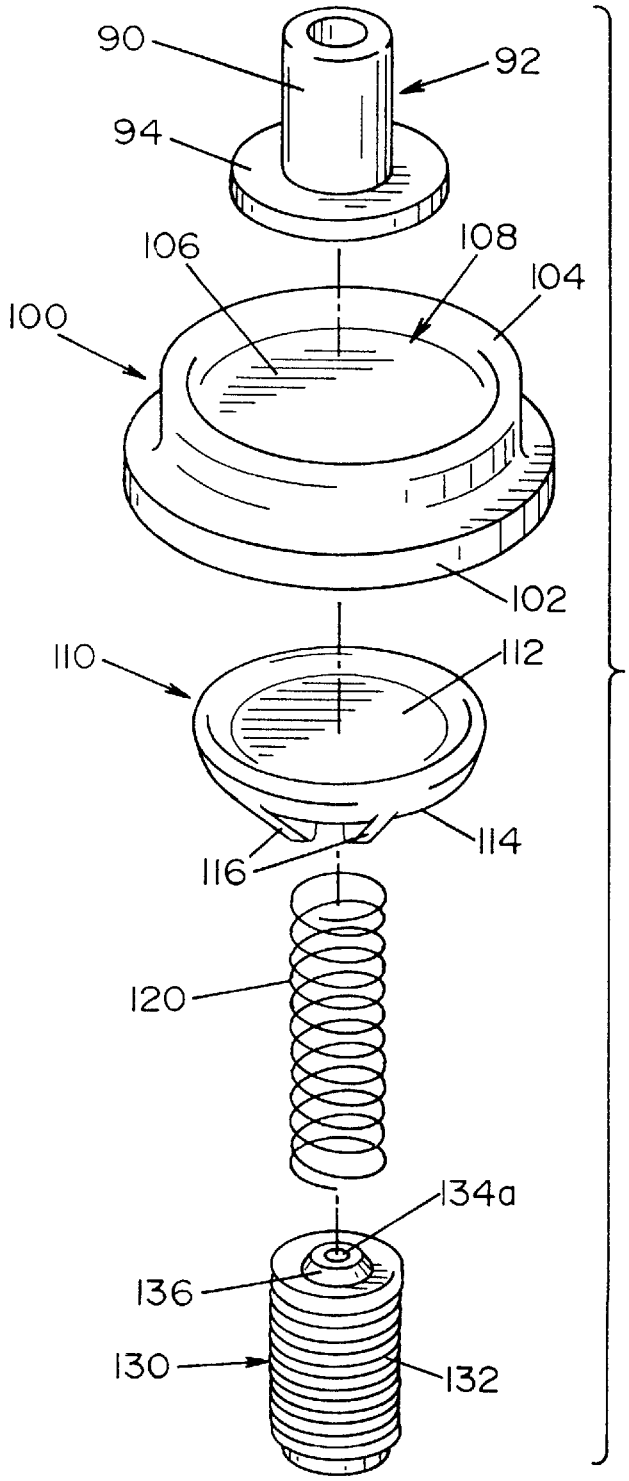
FIG. 5 is an exploded view of the operative components of the switch shown in FIG. 1.

Referring now to FIG. 5, the operative components of switch 10 are shown in exploded view. These components include an actuator 90, a diaphragm element 100, a pressure plate 110, a biasing element 120 and an adjustment element 130.

Figure 3:
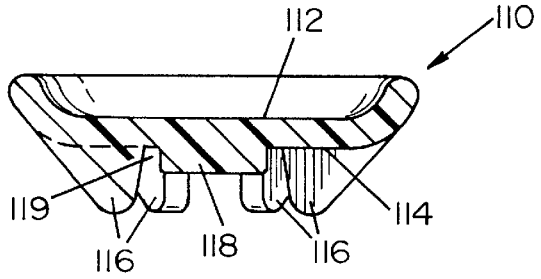
FIG. 3 is a sectional view of a pressure plate of the switch shown in FIG. 1.

Diaphragm element 100 is confined between base section 30 and cover section 50 to define the aforementioned pressure chamber 24 below diaphragm element 100 and pressure relief chamber 26 above diaphragm element 100. Diaphragm element 100 is symmetrical about a central axis and includes an outer, annular base portion 102, a generally U-shaped convolute portion 104 and a generally flat, inner portion 106. Convolute portion 104 and flat portion 106 of diaphragm element 100 define a smoothly, contoured, cup-shaped cavity 108. Diaphragm element 100 is preferably formed of a flexible, resilient polymer material and in the embodiment shown, is formed of silicone. Diaphragm element 100 is molded to have a neutral, unflexed configuration as shown in FIGS. 2 and 3. In this configuration, inner, flat portion 106 of diaphragm element 100, defines a generally flat, circular surface. This flat, circular surface is dimensioned to receive switch actuator 90. In the embodiment shown, switch actuator 90 has a tubular body portion 92 and a lower flange portion 94. Actuator 90 is dimensioned to be disposed within opening 64 defined by inner wall section 54 of upper cover section 50.

Figure 4:
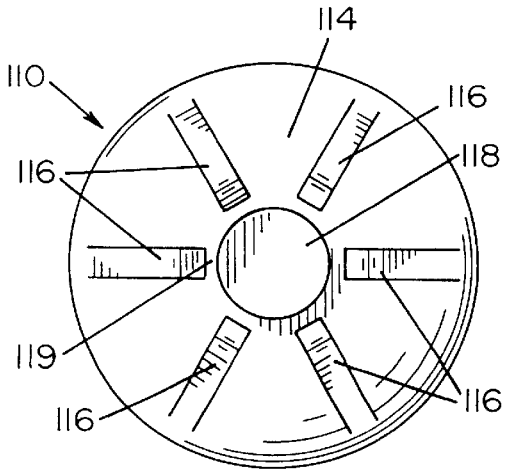
FIG. 4 is a bottom, plan view of the pressure plate shown in FIG. 3.

Below diaphragm element 100, pressure plate 110 (best seen in FIGS. 3 and 4) is provided. Pressure plate 110 is preferably plastic and has a first surface 112 facing diaphragm element 100 and a second surface 114 facing toward channel 38. In the embodiment shown, first surface 112 of pressure plate 110 is generally cup-shaped to mate with the lower surface of diaphragm element 100. Second surface 114 of pressure plate 110 includes a plurality of projections 116 that extend from second surface 114 thereof. In the embodiment shown, projections 116 are radially extending, planar walls that are generally rectangular in shape. Projections 116 are configured so that together they have a generally, conical configuration so as to mate with conical surface 46 that defines throat or recess 48 in base section 30. Pressure plate 110 includes a centrally located cylindrical boss 118 that extends from second surface 114. Projections 116 and mounting boss 118 define a generally annular gap 119 that is dimensioned to receive one end of biasing element 120. In the embodiment shown, biasing element 120 is a helical spring that is dimensioned to snuggly fit within annular gap 119 defined between the cylindrical boss 118 and projections 116.

Biasing element 120 is dimensioned to extend into channel 38 defined by shank 36. The lower end of biasing element 120 is dimensioned to engage adjustment element 130. Adjustment element 130 is basically for adjusting the position of biasing element 120. Adjustment element 130 has external threads 132 dimensioned to mate with internal threads 44 on shank 36. Adjustment element 130 includes a centrally, aligned opening 134 therethrough. Opening 134 includes a cylindrical portion **134*a* and a larger portion 134*b* of hexagonal cross-section. Portion 134*b* is dimensioned to receive a conventional hexagonal driver (i.e., an allen wrench) to allow for adjustment of adjustment element 130 to modify the tension on biasing element 120, as shall be described in greater detail below. Adjustment element 130 includes conically shaped locating boss 136 (best seen in FIGS. 2 and 5) on the upper end thereof. Locating boss 136 is dimensioned to receive one end of biasing element 120, as seen in FIG. 2**.

Referring now to a method of assembly, switch 10 is preferably assembled by inverting cover section 50 such that the opened end thereof, defined by inner and outer walls 52, 56, faces upward. Actuator 90 is placed within cylindrical opening 64 defined by inner wall 54. Diaphragm element 100 is then placed upon cylindrical flange portion 94 of actuator 90 with flange inner portion 106 of diaphragm element 100 resting upon flange portion 94 and outer base portion 102 resting upon the upper edges of outer wall 52 of cover section 50. Pressure plate 110 is then placed onto diaphragm element 100, with the first surface 112 of pressure plate 110 resting on inner portion 106 of diaphragm element 100, as shown in FIG. 2. One end of biasing element 120 is then mounted onto mounting boss 11 8. Base section 30 is then placed over cover section 50 and the entire assembly is pressed together until tabs 58 on cover section 50 snap lock into recesses 62 in base section 30.

As will be appreciated, as base section 30 is placed over cover section 50, the assembler is unable to visually see the internal components. Because of the cup-shaped configuration of diaphragm element 100 and pressure plate 110, alignment of the respective components is assured in that each component basically mates with the adjacent component. The contoured and cup-shaped configuration of the respective components insures that the components maintain their axial alignment as cover section 50 is snap locked together with base section 30.

As best seen in FIG. 2, in accordance with one aspect of the present invention, projections 116 on pressure plate 110 project into throat 48 defined by conical surface 46. This insures that during operation of the switch, pressure plate 110 will always seat itself relative to conical surface 46. Adjustment element 130 is used to adjust the force exerted by biasing element 120 on pressure plate 110. In this respect, biasing element 120 is provided to counteract the biasing force of switch button 72 and to move switch 70 to a first position as shown in FIG. 2, wherein switch button 72 is recessed within the housing of switch 70. In this position, diaphragm element 100 is in its normal unflexed position.

Referring now to the operation of switch 10, adjustment element 130 may be rotated (by a conventional hexagonal driver tool) to initially balance the forces exerted upon diaphragm element 100. Pneumatic switch 10 is then connected to a remote location by a hose or tube or pipe connection (not shown) connected to shank 36 by a conventionally known female fasteners (not shown). As indicated above, switch 10 is a vacuum switch operable to cause switch 70 to change from a first electrical state to a second electrical state when a vacuum of a predetermined level is applied to pressure chamber 24. The vacuum is conveyed from the remote source through the tubing or plumbing (not shown) through opening 134 in adjustment element 130, and through channel 38 in shank 36 to pressure chamber 24. Since the tipper chamber is exposed to the atmosphere through the openings in cover section 50, a vacuum generated in pressure chamber 24 causes pressure plate 110 and diaphragm element 100 to move downward. This downward movement allows switch button 72 to move under its own biasing force. Eventually, when switch button 72 has moved a predetermined distance, switch 70 will change from its first electrical state to a second electrical state. Importantly, projections 116 on pressure plate 110 define passages thereround such that when pressure plate 110 seats itself on conical surface 46 of throat 48, a vacuum will still be applied to diaphragm element 100 and pressure plate 110 via passageways around projections 116. In this respect, since pressure switch 10 is a momentary switch, switch 10 maintains its second electrical condition only so long as the vacuum remains in pressure chamber 24. By providing pressure plate 110, whose lower end is always within throat 48 defined by conical surface 46, and by providing passageways around projections 116, a vacuum is maintained upon diaphragm element 100 to maintain switch 70 in a second electrical state, for as long as the predetermined vacuum is applied to pressure chamber 24.

The present invention thus provides a reliable, vacuum actuated switch that has self-aligning components that make the switch easy to assemble and reliable during assembly.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A pressure switch, comprising:

a housing having a pressure chamber, a port communicating with said pressure chamber and a recessed throat located where said port communicates with said chamber;

a flexible diaphragm within said housing adjacent said pressure chamber;

an electric switch mounted to said housing; and a pressure plate disposed between said diaphragm and said port, said pressure plate having a first surface contoured to mate with a portion of said diaphragm and a second surface facing said port having a plurality of projections extending from said second surface, said projections dimensioned to engage said throat portion and maintain said second surface therefrom, said projections defining passageways where said port communicates with said chamber when said projections engage said throat.

2. A pressure switch as defined in claim 1, further comprising an adjustable biasing element biasing said pressure plate toward said switch.

3. A pressure switch as defined in claim 2, wherein said pressure plate includes a mounting boss dimensioned to receive and position said biasing element.

4. A pressure switch as defined in claim 2, wherein said biasing element is a spring, and said pressure plate includes a centrally located cylindrical boss on said second surface to receive one end of said spring.

5. A pressure switch as defined in claim 4, wherein said biasing element is partially disposed within said port.

6. A pressure switch as defined in claim 5, wherein said diaphragm has:

a first position, wherein said diaphragm has a neutral, unflexed configuration and said switch is in a first electrical state; and a second position, wherein said diaphragm is in a flexed configuration from a vacuum in said pressure chamber and said switch is in a second electrical state.

7. A pressure switch as defined in claim 6, wherein a portion of said projections are disposed within said throat when said diaphragm is in said first position.

8. A pressure switch as defined in claim 7, wherein said projections are walls.

9. A pressure switch as defined in claim 7, wherein said throat is generally conical in shape and said projections define a generally conical surface for engagement with said throat.

10. A pressure switch, comprising:

a housing having an upper housing section and a lower housing section, said lower housing section having a port extending therethrough and a contoured surface surrounding said port;

a diaphragm within said housing captured between said upper housing section and said lower housing section, said diaphragm defining a pressure relief chamber with said upper housing section, and a pressure chamber with said lower housing section, said diaphragm formed of a flexible material and having a neutral, unflexed configuration;

a pressure plate disposed between said diaphragm and said port, said pressure plate having a first surface contoured to mate with a portion of said diaphragm; and a second surface facing said port having a projection extending from said second surface, said projection dimensioned to engage said contoured surface and to maintain said second surface therefrom, said projection defining a passageway wherein said port communicates with said chamber when said projection engages said contoured surface.

11. A pressure switch as defined in claim 10, wherein said contoured surface is conical in shape and surrounds said port wherein said port communicates with said pressure chamber.

12. A pressure switch as defined in claim 11, wherein said pressure plate includes a plurality of projections having outwardly facing surfaces that mate with said conical, contoured surface.

* * * * *